US009333468B2

(12) United States Patent
Nguyen et al.

(10) Patent No.: US 9,333,468 B2
(45) Date of Patent: May 10, 2016

(54) SOAK VESSELS AND METHODS FOR IMPREGNATING BIOMASS WITH LIQUID

(71) Applicant: Abengoa Bioenergy New Technologies, LLC, Chesterfield, MO (US)

(72) Inventors: Quang A. Nguyen, Chesterfield, MO (US); Weidong He, Chesterfield, MO (US); Leroy D. Holmes, Florissant, MO (US)

(73) Assignee: Abengoa Bioenergy New Technologies, LLC, Chesterfield, MO (US)

( * ) Notice: Subject to any disclaimer, the term of this patent is extended or adjusted under 35 U.S.C. 154(b) by 812 days.

(21) Appl. No.: 13/625,522

(22) Filed: Sep. 24, 2012

(65) Prior Publication Data

US 2014/0083918 A1 Mar. 27, 2014

(51) Int. Cl.

| | |
|---|---|
| ***B01F 7/16*** | (2006.01) |
| ***B01F 7/00*** | (2006.01) |
| ***D21C 3/04*** | (2006.01) |
| ***D21C 7/08*** | (2006.01) |
| ***D21C 11/00*** | (2006.01) |
| ***B01F 7/22*** | (2006.01) |
| ***B01F 15/02*** | (2006.01) |

(52) U.S. Cl.

CPC ..... *B01F 7/16* (2013.01); *B01F 7/00633* (2013.01); *B01F 7/00641* (2013.01); *B01F 7/1675* (2013.01); *B01F 7/22* (2013.01); *B01F 15/0288* (2013.01); *D21C 3/04* (2013.01); *D21C 7/08* (2013.01); *D21C 11/0007* (2013.01); *B01F 2215/0422* (2013.01)

(58) Field of Classification Search

CPC ..... B01F 7/16; B01F 7/00641; B01F 2215/0422; B01F 7/00633; B01F 7/1675; B01F 7/22; B01F 15/0288; D21C 3/04; D21C 7/08; D21C 11/0007

See application file for complete search history.

(56) References Cited

U.S. PATENT DOCUMENTS

| | | | | |
|---|---|---|---|---|
| 3,518,935 | A | 7/1970 | Richter | |
| 3,796,148 | A | 3/1974 | Heissenberger | |
| 3,796,149 | A | 3/1974 | Heissenberger | |
| 3,941,650 | A | 3/1976 | Schnyder | |
| 4,028,171 | A * | 6/1977 | Richter | 162/19 |
| 4,237,226 | A | 12/1980 | Grethlein | |
| 4,280,902 | A | 7/1981 | Jacobsen et al. | |
| 4,594,228 | A | 6/1986 | Lambert, Jr. et al. | |

(Continued)

FOREIGN PATENT DOCUMENTS

| | | | |
|---|---|---|---|
| EP | 1295986 | B1 | 8/2004 |
| EP | 1988211 | A2 | 11/2008 |

(Continued)

OTHER PUBLICATIONS

International Search Report and Written Opinion, Application No. PCT/US2013/058726, dated Jan. 21, 2014, pp. 12.

(Continued)

*Primary Examiner* — Alexander Markoff

(74) *Attorney, Agent, or Firm* — Armstrong Teasdale LLP

(57) ABSTRACT

Soak vessels for impregnating biomass with a liquid such as a dilute acid and methods for impregnating biomass are disclosed. In some embodiments, the soak vessel includes an impeller assembly with impellers that create a vortex to submerge the biomass, that agitate and separate contaminants from the biomass and that direct biomass and contaminants to separate vessel outlets.

32 Claims, 8 Drawing Sheets

(56) References Cited

U.S. PATENT DOCUMENTS

| | | | | |
|---|---|---|---|---|
| 4,851,119 | A | 7/1989 | Bergloff et al. | |
| 5,052,892 | A | 10/1991 | Fasano | |
| 5,203,996 | A | 4/1993 | Scheucher et al. | |
| 5,566,611 | A | 10/1996 | Scheucher et al. | |
| 5,567,279 | A | 10/1996 | Phillips et al. | |
| 5,882,509 | A | 3/1999 | Perman | |
| 5,972,661 | A | 10/1999 | Kubera et al. | |
| 5,972,695 | A | 10/1999 | Murofushi et al. | |
| 5,985,096 | A | 11/1999 | Marcoccia et al. | |
| 6,109,449 | A | 8/2000 | Howk et al. | |
| 6,197,160 | B1 | 3/2001 | Sbaschnigg et al. | |
| 6,217,710 | B1 | 4/2001 | Scherz et al. | |
| 6,228,220 | B1 | 5/2001 | Hada et al. | |
| 6,334,933 | B1 | 1/2002 | Koski | |
| 6,432,264 | B2 | 8/2002 | Prough et al. | |
| 6,451,163 | B2 | 9/2002 | Prough et al. | |
| 6,660,506 | B2 | 12/2003 | Nguyen et al. | |
| 7,141,143 | B2 | 11/2006 | Juutinen | |
| 7,357,074 | B2 | 4/2008 | Kraft et al. | |
| 7,846,298 | B2 | 12/2010 | Thorgersen et al. | |
| 7,988,822 | B2 | 8/2011 | Stromberg | |
| 2003/0111200 | A1 | 6/2003 | Prough et al. | |
| 2004/0234435 | A1 | 11/2004 | Bickham et al. | |
| 2005/0224198 | A1 | 10/2005 | Snekkenes et al. | |
| 2008/0025144 | A1 | 1/2008 | Kocienski et al. | |
| 2008/0257511 | A1* | 10/2008 | Thorgersen et al. | 162/244 |
| 2010/0043995 | A1 | 2/2010 | Lovgren et al. | |
| 2010/0048371 | A1 | 2/2010 | Mossberg | |
| 2010/0056774 | A1* | 3/2010 | Anand et al. | 536/124 |
| 2010/0270411 | A1 | 10/2010 | Vuorio et al. | |
| 2010/0294708 | A1 | 11/2010 | Ponten et al. | |
| 2011/0079219 | A1 | 4/2011 | McDonald et al. | |
| 2011/0262984 | A1* | 10/2011 | Nguyen | 435/165 |
| 2011/0275860 | A1 | 11/2011 | Beldring et al. | |
| 2012/0006320 | A1 | 1/2012 | Nguyen | |
| 2012/0009643 | A1 | 1/2012 | Hafez et al. | |
| 2012/0037325 | A1 | 2/2012 | Beldring et al. | |
| 2012/0211512 | A1 | 8/2012 | Pschorn et al. | |
| 2013/0005010 | A1 | 1/2013 | Bell et al. | |

FOREIGN PATENT DOCUMENTS

| | | | |
|---|---|---|---|
| EP | 1813721 | B1 | 12/2008 |
| EP | 1444395 | B1 | 9/2010 |
| JP | 59191593 | | 10/1984 |
| JP | 2004090049 | | 3/2004 |
| JP | 2010253536 | | 11/2010 |
| WO | 9742374 | | 11/1997 |
| WO | 2005098127 | A1 | 10/2005 |
| WO | 2006068569 | A1 | 6/2006 |
| WO | 2008000902 | A2 | 1/2008 |
| WO | 2010022511 | A1 | 3/2010 |
| WO | WO 2010081478 | A1 * | 7/2010 |
| WO | 2010116026 | A1 | 10/2010 |
| WO | 2011002354 | A1 | 1/2011 |
| WO | 2011007369 | A1 | 1/2011 |
| WO | 2011091044 | A1 | 7/2011 |
| WO | 20110104209 | A1 | 9/2011 |
| WO | 2012016180 | A2 | 2/2012 |
| WO | 2012049367 | A1 | 4/2012 |

OTHER PUBLICATIONS

Non-Final Office Action, U.S. Appl. No. 13/625,529, dated Apr. 21, 2014, pp. 42.

International Search Report and Written Opinion, Application No. PCT/US2013/058733, dated Dec. 3, 2013, pp. 10.

International Search Report and Written Opinion, Application No. PCT/US2013/058747, dated Jan. 21, 2014, pp. 11.

Kim, et al., Diffusion of Sulfuric Acid within Lignocellulosic Biomass Particles and its Impact on Dilute-Acid Pretreatment, Bioresource Technology, 2002, pp. 165-171, vol. 83, Elsevier.

Linde, et al., Steam Pretreatment of Acid-Sprayed and Acid-Soaked Barley Straw for Production of Ethanol, Applied Biochemistry and Biotechnology, 2006, pp. 546-562, vol. 129-132, Humana Press Inc.

Chemineer, Advanced Impeller Technology for Superior Performance, Bulletin 710, 2009, 4 pages.

Malkov, et al., Towards Complete Impregnation of Wood Chips with Aqueous Solutions, Paperi ja Puu—Paper and Timber, 2001, 6 pages, vol. 83, No. 6.

Zimbardi, et al., Acid Impregnation and Steam Explosion of Corn Stover in Batch Processes, Science Direct, Industrial Crops and Products, 2007, pp. 195-206, vol. 26, Elsevier.

Bakker A., et al., The Drawdown and Dispersion of Floating Solids in Aerated and Unaerated Stirred Vessels, Chem. Eng. Res. Des., 1989, pp. 208-210, vol. 67.

Khazam et al., Drawdown of Floating Solids in Stirred Tanks, 13th European Conference on Mixing, 2009, pp. 1-8, Department of Chemical and Materials Engineering, University of Alberta.

Lundberg Chip Washers, http://www.ahlundberginc.com/chip_washers.htm (publicatinon date unknown—available prior to filing).

Chemineer, HE-3 High-Efficiency Impeller, Bulletin 713, 1996, 2 pages.

Kandakure, et al., CFD Study of Slurry Homogenizer, Seventh International Conference of CFD in the Minerals and Process Industries, 2009, CSIRO Australia.

Tucker, et al., Effects of Temperature and Moisture on dilute-Acid Steam Explosion Pretreatment of Corn Stover and Cellulase Enzyme Digestibility, Applied Biochemistry and Biotechnology, Biotechnology for Fuels and chemicals, 2003, vol. 105, No. 1-3, ISSN 0273-2289, Humana Press.

Andritz-Chip Washer, Commerical Chip Washing systems for MDF and Mechanical Pulping Industries, 6 pages, http://www.andritz.com/ANONIDZFEDB9C9E70F520C0/ppp-panelboard/ppp-panelboard-mdf/ppp-panelboard-mdf-swc/ppp-panelboard-cwd/ppp-panelboard-cw.htm (publication date unknown—available prior to filing).

J. Wu, et al., Impeller Geometry Effect on Velocity and Solids Suspension, 14 pages, CSIRO thermal and Fluids Engineering.

U.S. Statutory Invention Registration, H1681, Oct. 7, 1997, Johanson et al.

Post Mixing Optimization and Solutions, 2010, http://www.postmixing.com/mixing forum/impellers/pbt.htm.

* cited by examiner

SOAK VESSELS AND METHODS FOR IMPREGNATING BIOMASS WITH LIQUID

FIELD OF THE DISCLOSURE

The field of the disclosure relates to soak vessels for impregnating biomass with a liquid such as a dilute acid and to method for impregnating biomass. In some embodiments, the soak vessel includes an impeller assembly with impellers that create a vortex to submerge the biomass, that agitate and separate contaminants from the biomass and that direct biomass and contaminants to separate vessel outlets.

BACKGROUND

Biofuels such as ethanol have seen increased use as an additive or replacement for petroleum-based fuels such as gasoline. Ethanol may be produced by fermentation of simple sugars produced from sources of starch (e.g., corn starch) or from lignocellulosic biomass.

There are a variety of widely available sources of lignocellulosic biomass including, corn stover, agricultural residues (e.g., straw, corn cobs, etc.), woody materials, energy crops (e.g., sorghum, poplar, etc.), and bagasse (e.g., sugarcane). Lignocellulosic biomass is a relatively inexpensive and readily available feedstock for the preparation of sugars, which may be fermented to produce alcohols such as ethanol.

Preparation of ethanol from biomass involves methods for increasing the accessibility of cellulose to downstream enzymatic hydrolysis. There is a continuing need for methods for preparing biomass for enzymatic hydrolysis that result in removal of contaminants from biomass feedstock and that involve relatively uniform impregnation of biomass with processing fluid (e.g., dilute acid).

This section is intended to introduce the reader to various aspects of art that may be related to various aspects of the disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

SUMMARY

One aspect of the present disclosure is directed to a soak vessel for impregnating biomass with liquid and removing contaminants. The vessel includes a housing defining a main chamber and a tapered chamber. A biomass outlet is formed in the housing. A contaminant outlet is formed in the lower end of the vessel. The vessel also includes an impeller assembly having a first impeller, a second impeller and a third impeller. The first impeller is within the main chamber and is configured to create a vortex to submerge the biomass. The second impeller is within the main chamber and is configured to agitate the biomass and separate contaminants from the biomass. The third impeller is within the tapered chamber and is configured for sweeping biomass through the biomass outlet and forcing contaminants toward the contaminant outlet.

Another aspect of the present disclosure is directed to a method for impregnating biomass with liquid and removing contaminants. A biomass feedstock is introduced into a soak vessel for impregnating biomass with liquid and removing contaminants. The soak vessel has a housing defining a main chamber and a tapered chamber. A first impeller rotates within the main chamber to create a vortex to submerge the biomass. A second impeller rotates within the main chamber to agitate the biomass and separate contaminants from the biomass. A third impeller rotates within the tapered chamber to sweep biomass through the biomass outlet and force contaminants toward the contaminant outlet.

Various refinements exist of the features noted in relation to the above-mentioned aspects of the present disclosure. Further features may also be incorporated in the above-mentioned aspects of the present disclosure as well. These refinements and additional features may exist individually or in any combination. For instance, various features discussed below in relation to any of the illustrated embodiments of the present disclosure may be incorporated into any of the above-described aspects of the present disclosure, alone or in any combination.

BRIEF DESCRIPTION OF THE DRAWINGS

Corresponding reference characters indicate corresponding parts throughout the drawings.

DETAILED DESCRIPTION

Figure 1:
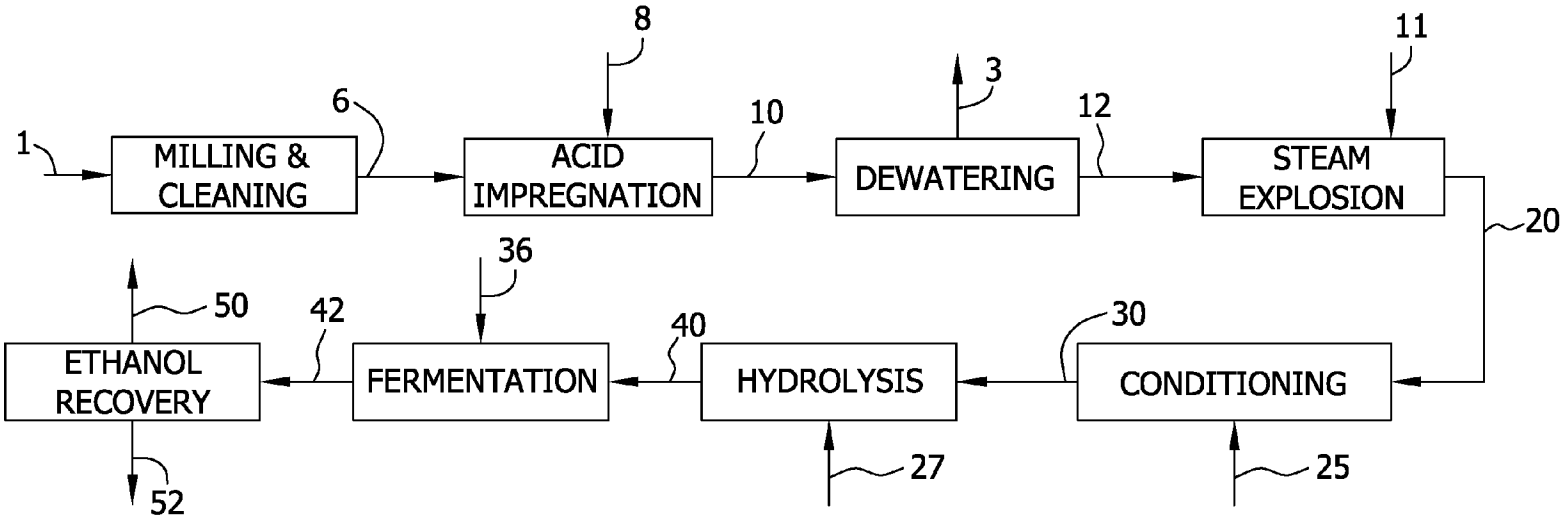
FIG. 1 is a flow chart depicting a method for producing ethanol from a cellulosic biomass feedstock.

In accordance with various embodiments of the present disclosure and with reference to FIG. 1, lignocellulosic biomass material 1 is subjected to milling and cleaning operations to reduce the particle size of the material and to remove any non-biomass contaminants from the feedstock. Any of a variety of biomass materials may be used as the starting feedstock of embodiments of the present disclosure including plant biomass, agricultural or forestry residues, or sugar processing residues. Suitable grass materials include cord grass, reed canary grass, clover, switchgrass, bamboo, marram grass, meadow grass, reed, ryegrass, sugar cane, and grasses from the *Miscanthus* genus. The biomass feedstock may include agricultural residues such as rice straw, rice hulls, barley straw, corn cobs, wheat straw, canola straw, oat straw, oat hulls, corn fiber, stover (e.g., sorghum, soybean stover and/or corn stover) or combinations thereof. Sugar processing residues include sugar cane bagasse, sweet sorghum, beet pulp, and combinations thereof. The feedstock may also include wood and forestry wastes such as, for example, recycled wood pulp fiber, sawdust, hardwood, softwood, forest thinnings, orchard thinnings, or combinations thereof. Other materials such as residential yard waste, wood debris from construction and demolition sites and cellulosic materials sorted from municipal wastes may also be used in the feedstock. The content of such municipal wastes may vary (e.g., from about 15 wt % to about 50 wt % cellulose on a dry basis, from about 5 wt % to about 30 wt % hemicellulose on a dry basis and/or from about 10 wt % to about 40 wt % lignin on a dry basis).

The biomass feedstock may have a cellulose content of at least about 15 wt % on a dry basis or, as in other embodiments, at least about 25 wt %, at least about 30 wt %, at least about 35 wt % or at least about 50 wt % cellulose on a dry basis (e.g., from about 15 wt % to about 55 wt % or from about 25 wt % to about 45 wt %). Alternatively or in addition, the biomass feedstock may contain at least about 5 wt % hemicellulose on a dry basis or at least about 15 wt %, at least about 20% or at least about 25 wt % hemicellulose on a dry basis (e.g., from about 10 wt % to about 30 wt % or from about 15 wt % to about 25 wt %). Alternatively or in addition, the biomass material may include at least about 10 wt % lignin on a dry basis or at least about 15 wt %, at least about 20 wt % or at least about 25 wt % lignin on a dry basis (e.g., from about 10 wt % to about 40 wt % or from about 15 wt % to about 25 wt %). In this regard, the biomass feedstock may contain cellulose, hemicellulose and/or lignin in any range bound by the above-listed parameters and in any combination of respective ranges. The biomass material 1 may be bound by any combination of the above-noted parameters including any combination of the cellulose, hemicellulose and lignin parameters provided above. It should be noted that the recited ranges are exemplary and the biomass feedstock may contain more or less cellulose, hemicellulose and/or lignin without limitation. Any biomass material suitable for preparing fermentable sugars may be used unless stated otherwise.

The feedstock may include components other than cellulose, hemicellulose and lignin such as ash including structural inorganics and may include contaminants (e.g., gravel, sand or dirt). In various embodiments, the biomass feedstock may contain about 1 wt % or less ash on a dry basis, about 3 wt % or less ash, about 5 wt % or less ash or about 8 wt % or less ash on a dry basis. The biomass feedstock may contain moisture and in some embodiments contains at least about 1 wt % (by total weight including moisture) moisture, at least about 5 wt %, at least about 10 wt %, at least about 15 wt % or even at least about 20 wt % moisture (e.g., from about 1 wt % to about 30 wt %, from about 1 wt % to about 20 wt % or from about 5 wt % to about 20 wt % moisture).

The biomass feedstock material may undergo one or more milling operations to reduce the particle size of the material before downstream processing. In some embodiments, the biomass material 1 is reduced to a size less than about 40 mm or from about 2 mm to about 30 mm or from about 5 mm to about 30 mm. Relatively large biomass material (e.g., greater than about 40 mm or greater than about 50 mm) may result in low bulk density which increases the size of equipment (e.g., conveyors) and may impede impregnation and heating. Relatively small biomass (e.g., less than about 2 mm or less than about 0.5 mm) may hold large amounts of liquid resulting in longer heating times. Any equipment suitable to reduce the particle size of the biomass material 1 may be used including, for example, hammermills, grinders, cutters, chippers, crushers and the like. In some embodiments, the biomass feedstock is not milled prior to downstream processing.

Alternatively or in addition, the biomass feedstock may undergo a cleaning operation to remove contaminants from the feedstock. Suitable operations include sifting, air classifying to remove gravel, sand and fines, and contacting the feedstock with one or more magnets to remove ferrous material from the feedstock.

After milling, the milled biomass 6 is subjected to a fluid-impregnation process (e.g., dilute acid-impregnation) and steam explosion process to cause the cellulose in the biomass to become more available to enzymatic hydrolysis. Acid impregnation generally involves contacting the milled biomass with acid (e.g., dilute acid) in a vessel for a time sufficient to allow the fluid to thoroughly contact and be dispersed throughout the biomass.

In some particular embodiments, milled biomass 6 is added to a soak vessel (or "soak tank") 32 (FIG. 2) to thoroughly contact the biomass with liquid 8. The milled and cleaned biomass feedstock 6 may optionally be preheated with direct steam contact at less than about 1 bar pressure to open up the pore structure and drive out entrapped air before feeding the biomass to the acid impregnator. The steaming time may be sufficient to heat the biomass to at least about 40° C., at least about 60° C. or at least about 80° C.

Biomass 6 may be added to the soak vessel 32 through one or more screw feeders (not shown) that create a plug of biomass in the feeder to prevent vapor from exiting the vessel through the screw feeder. The plug may be created by use of weighted dampers that also close and seal the entry point of biomass. Biomass may be added through the top or sidewall of the vessel 32 and liquid may be added through one or more nozzles that extend into the top or sidewall of the vessel 32. Spray nozzles may be used to wet biomass as it exits the screw feeder. The wetted biomass particles are relatively less buoyant than dry particles.

The soak vessel 32 includes a housing 45 which defines a main chamber 38 and a tapered chamber 44. The vessel 32 also includes a biomass outlet 14 formed in the housing 45 and a contaminant outlet 16 formed in the lower end 63 of the vessel 32. The tapered chamber 44 may have one or more biomass slurry outlets 14, and each outlet may be in fluid communication with downstream dewatering operations (such as a dewatering screw conveyor). In some embodiments, the location of the outlet 14 is within the upper 70% of the tapered wall to lessen the chance of heavy contaminants exiting with the biomass slurry.

The vessel 32 also includes an impeller assembly. The assembly includes an upper impeller 22 (or "first" impeller) within the main chamber 38 that may be located near the top surface of the slurry in the vessel 32. The upper impeller 22 is attached to an impeller shaft 5 and may be configured to create a vortex in the slurry to submerge the biomass introduced into the vessel into the slurry.

Figure 4:
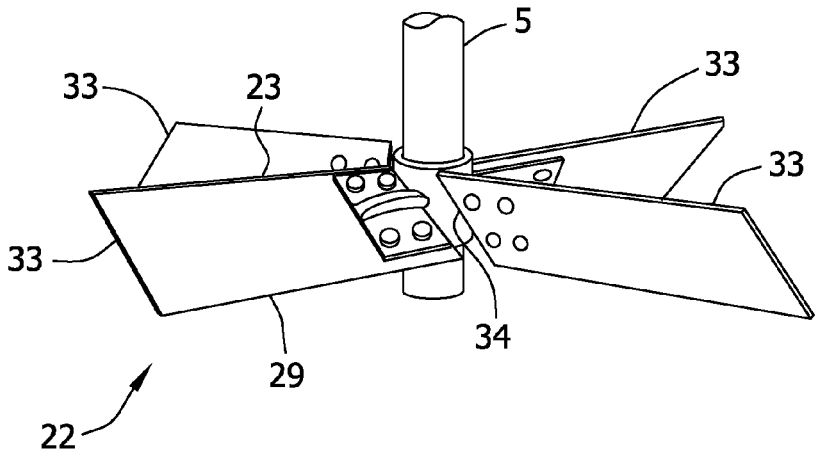
FIG. 4 is a perspective view of an impeller for creating a vortex to submerge biomass.
Figure 5:
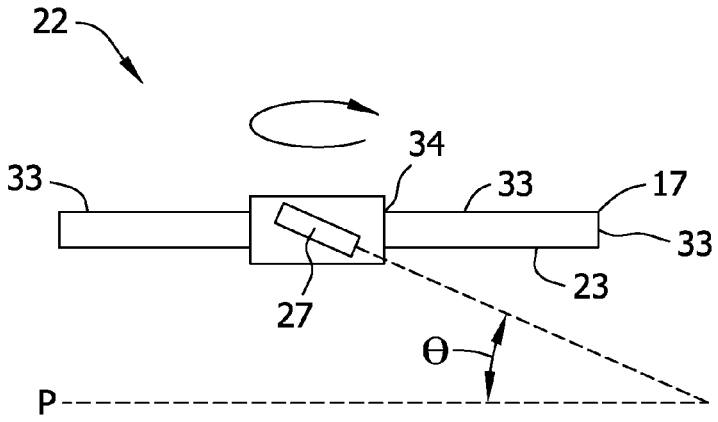
FIG. 5 is a side view of the impeller of FIG. 4.

Referring now to FIG. 4, the upper impeller 22 includes four blades 33 about equally spaced about the shaft 5. The impeller 22 may include more or less blades without limitation. Each blade 33 is pitched to facilitate creating a vortex in the slurry to submerge the biomass. As used herein and as shown in FIG. 5, the pitch (which may also be referred to herein as "pitch angle") is the angle the blade makes with the plane of rotation (or a plane P parallel to the plane of rotation as shown in FIG. 5). In embodiments wherein the pitch varies from the root end 34 (i.e., where the blade is attached to a hub or the shaft 5) of the blade 33 to the tip end 17 of the blade (e.g., as in "progressively" pitched impellers), the "pitch" of the blade as used herein refers to the pitch at the root end 34 of the blade. Further, if the pitch varies from the leading edge 23 to the trailing edge 29 of the blade, the "pitch" as used herein refers to the angle formed between the plane P of rotation of the impeller 22 and a straight-line chord that extends from the leading edge 23 to the trailing edge 29 of the blade 33. In some embodiments, the pitch θ of the blades 33 of the upper impeller 22 is from about 30° to about 60° or, as in other embodiments, from about 40° to about 50° (e.g., about 45°). The upper impeller 22 may promote moderate axial flow (or "pumping") and tangential flow in order to quickly submerge the floating biomass particles. The impeller 22 may be up-pumping or down-pumping. An up-pumping impeller 22 may be relatively more efficient in submerging light biomass particles that are more buoyant due to an increase in circulation of liquid in the upper section.

The ratio of the diameter of the upper impeller 22 to the vessel diameter may be from about 0.25 to about 0.5 or, as in other embodiments, from about 0.3 to about 0.4. The upper impeller 22 may be located below the liquid surface to minimize drawing air into the liquid which could impede the contact of fluid with the biomass particles. In some embodiments, the distance between the top edge of the blades 33 of the upper impeller 22 and the surface of the liquid is from about 0.3 to about 1.5 times the diameter of the impeller or from about 0.5 to about 1 times the impeller diameter.

The impeller assembly includes a central impeller 24 (or "second" impeller) within the main chamber 38 (FIG. 2) that may be configured to agitate the biomass. The ratio of the diameter of the central impeller 24 to the diameter of the vessel may be about 0.3 to about 0.6 or about 0.4 to about 0.5. The central impeller 24 may promote strong axial flow (i.e., pumping action) and less radial flow. These flow patterns in the presence of vertical tank baffles (described below) result in vigorous and turbulent mixing in the middle section of the main chamber 38 of the soak vessel 32. The impeller 24 may be up-pumping or down-pumping. By agitating the biomass, contaminants (e.g., tramp material such as coarse sand, metal, gravel and dense biomass) may be separated from the biomass which allows the contaminants to be removed from the slurry as further explained below. Vigorous agitation also dislodges air entrained with the biomass and facilitates better contact of liquid throughout the biomass, which enhances the rate and uniformity of mass and heat transfer into the biomass structure.

Figure 6:
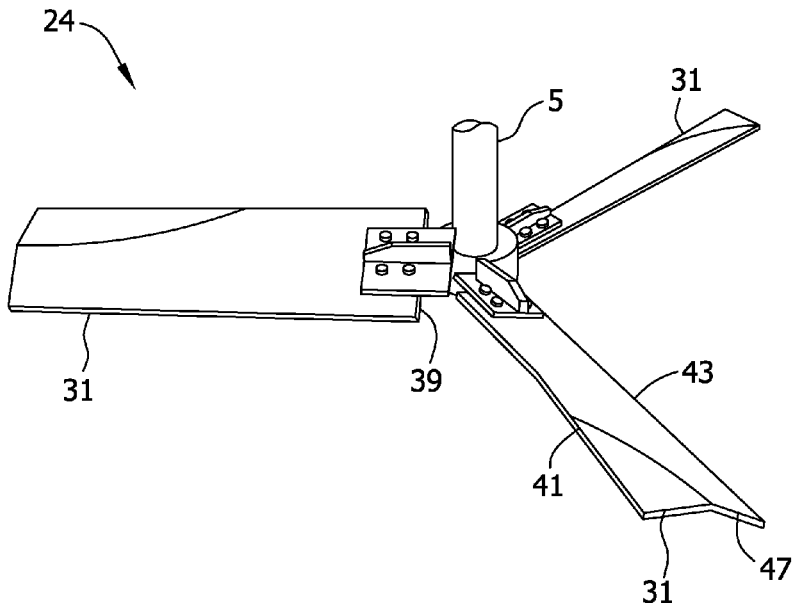
FIG. 6 is a perspective view of an impeller for mixing biomass to separate contaminants from the biomass.

The central impeller 24 includes three blades 31 (FIG. 6) equally spaced about the shaft 5. The impeller 24 may include two blades or four or more blades. The blades 31 are pitched to agitate the biomass. In some embodiments, the blades 31 are pitched less than the blades 33 of the upper impeller 22. The pitch of the blades 33 may be from about 5° to about 45° or, as in other embodiments, from about 15° to about 45° or from about 25° to about 35° (e.g., about) 30°.

The blades 31 include a leading edge 41, trailing edge 43 and a root end 39 and tip end 47. In some embodiments, a portion of the blade 31 (e.g., a portion including the leading edge 41 and tip end 47) may be bent at an angle relative to the remainder of the blade. The bend angle may range from about 10° to about 30°. The blades 31 may have additional bends or, as in some embodiments, may be partially or continuously curved from the leading edge 41 to the trailing edge 43. Similarly, the blades 33 of the upper impeller 22 or of other impellers described herein may also have bends or curves.

Figure 2:
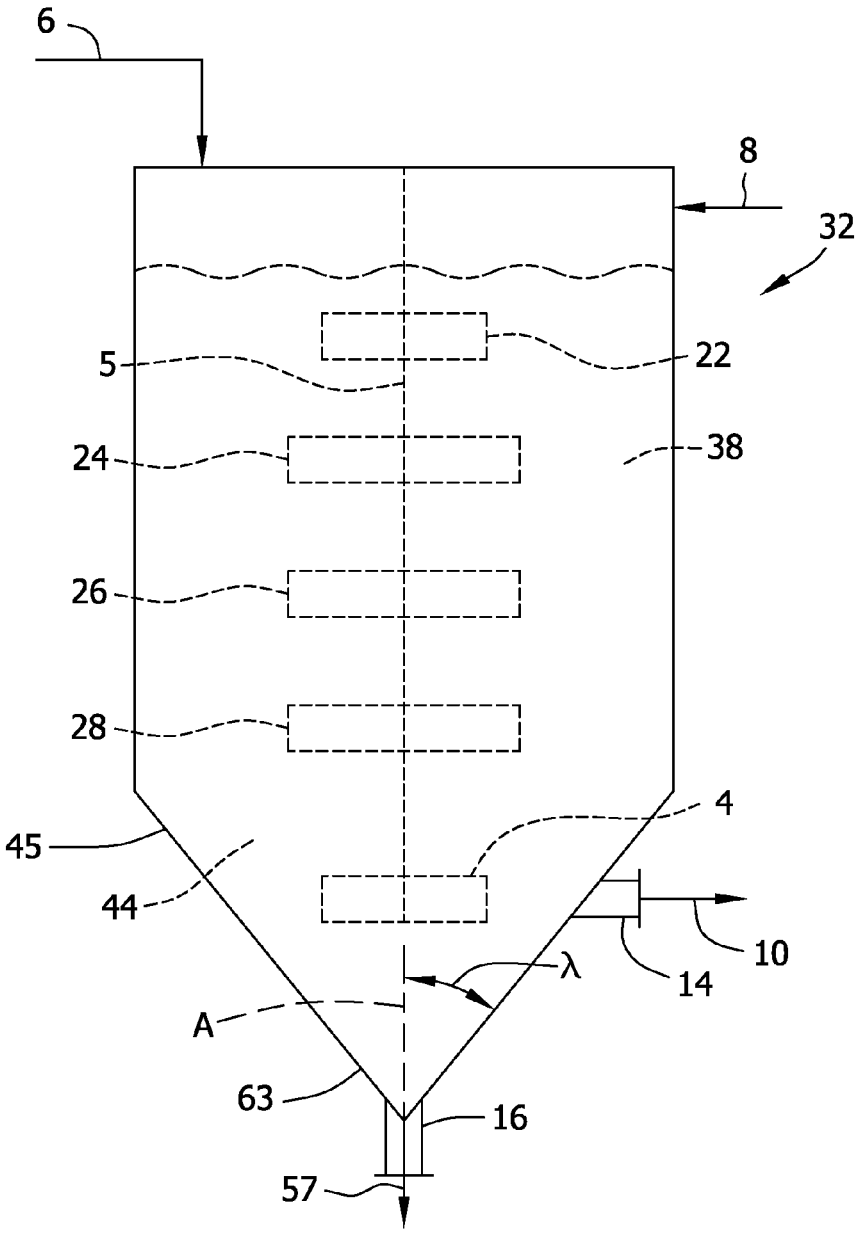
FIG. 2 is a side view of a soak tank for impregnating biomass with liquid.
Figure 7:
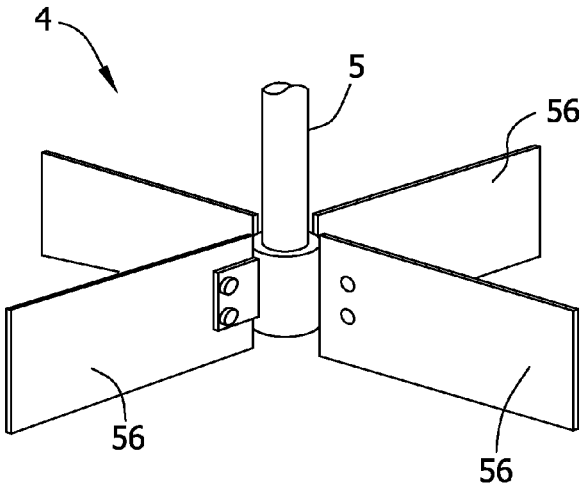
FIG. 7 is a perspective view of an impeller for directing biomass and contaminants to separate soak tank outlets.

The impeller assembly also includes a lower impeller 4 (or "third" impeller) (FIG. 7) within the tapered chamber 44 (FIG. 2) that may be configured for sweeping biomass through the biomass outlet 14 and forcing contaminants (e.g., heavy contaminants) toward the contaminant outlet 16. As shown in FIG. 2, the axial position of the lower impeller 4 may be near or at the biomass outlet 14 to promote removal of biomass through the outlet 14. The ratio of the diameter of the lower impeller 4 to the diameter of the tapered section near or at the outlet 4 may be about 0.25 to about 0.5 or about 0.3 to about 0.4. The lower impeller 4 may promote a relatively strong tangential flow pattern.

The impeller 4 may be pitched more than the upper impeller 22 and/or the central impeller 24. In some embodiments, the lower impeller 4 is pitched at least about 75° or even at least about 85° (e.g., about 90°). The lower impeller 4 and the tapered shape of the housing 45 allow the biomass to be swirled in the tapered chamber 44. Swirling of biomass creates a centrifugal force which allows the heavy contaminants to fall toward the lower end 63 of the vessel 32 and the lighter biomass to be withdrawn through the outlet(s) 14.

Contaminants 57 may be removed continually or intermittently from the contaminant outlet 16 of the vessel 32. For example, contaminants may be removed intermittently by use of a trap (e.g., two slide gate valves or gates) to isolate the contaminants and remove them from the vessel 32. Contaminants may be removed by addition of process water or dilute acid into the trap. Contaminants may optionally be centrifuged for recycle of biomass and liquid trapped with the contaminants and/or may be washed. Collected contaminants may be neutralized and disposed of such as by land-filling.

Referring again to FIG. 2, the portion of the housing 45 which forms the tapered chamber 44 forms an angle λ, with the vertical axis of the vessel 32 to promote swirling of biomass and effective discharge of biomass from the vessel 32. The angle λ, formed between the tapered wall and the vertical axis A may be from 25° to about 60° or, as in other embodiments, from about 30° to about 45°.

The upper impeller 22 is positioned axially above the central impeller 24 and the lower impeller 4 is positioned axially below the central impeller 24. The impeller assembly may include impellers other than the upper impeller 22, central impeller 24 and lower impeller 4. As shown in FIG. 2, the impeller assembly also includes a second central impeller 26 (or "fourth" impeller) and third central impeller 28 (or "fifth" impeller). The second central impeller 26 and third central impeller 28 may be configured to agitate the biomass and separate contaminants from the biomass. For example, the second central impeller 26 and third central impeller 28 may be shaped and/or sized similar to the first central impeller 24. The pitch of the blades of the second central impeller 26 and/or blades of the third central impeller 28 may be from about 5° to about 45° or, as in other embodiments, from about 15° to about 45° or from about 25° to about 35° (e.g., about) 30°. As shown in FIG. 2, when the impeller assembly includes a second central impeller 26 and third central impeller 28, the upper impeller 22 may be positioned axially above the first central impeller 24, the first central impeller 24 is positioned above the second central impeller 26, the second central impeller 26 is positioned above the third central impeller 28 and the third central impeller 28 is positioned above the lower impeller 4.

The impeller assembly may include additional impellers, and one or more of the impellers described herein may be eliminated or may be substituted for other impellers. The impellers described herein may include chamfered leading edges or trailing edges. A rate of rotation of the impellers is selected for suitable biomass submergence, contaminant separation and/or agitation.

Figure 8:
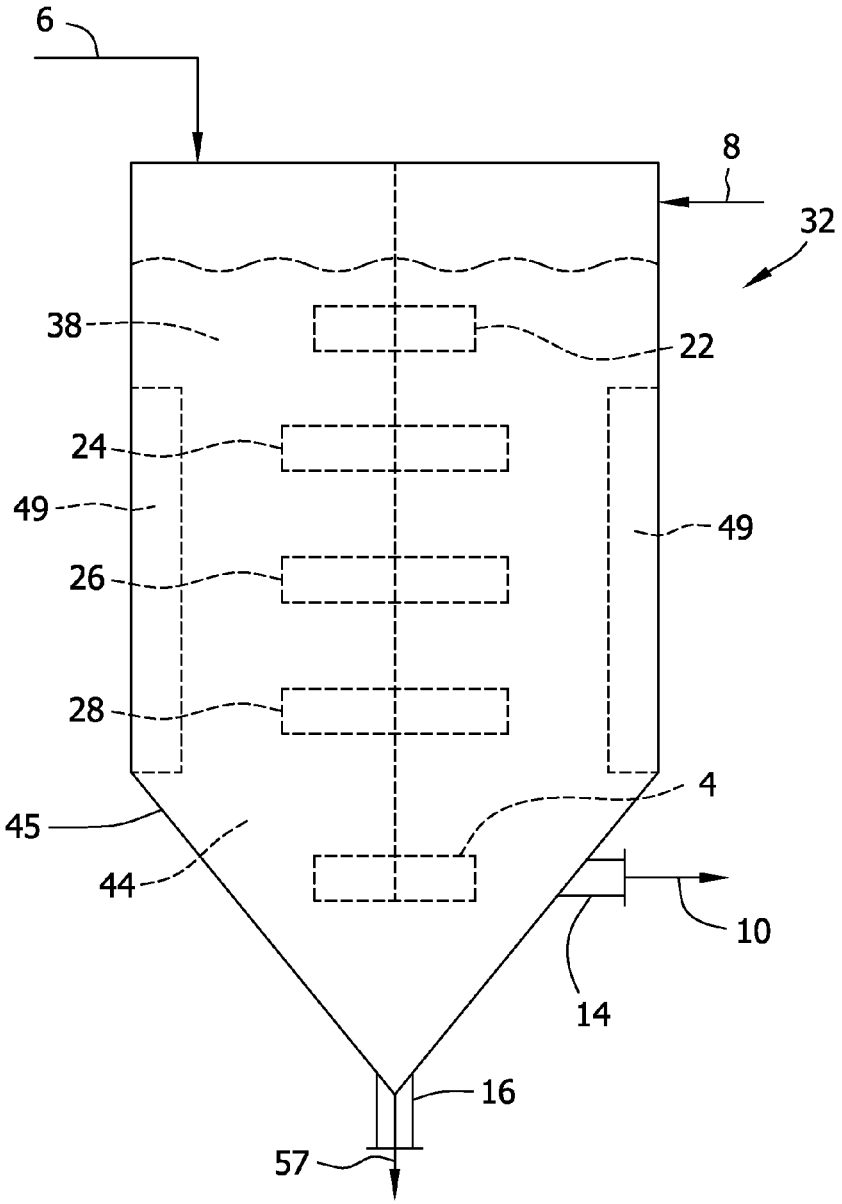
FIG. 8 is a side view of a soak tank with vertical baffles for impregnating biomass with liquid.

In some embodiments of the present disclosure and as shown in FIG. 8, the vessel 32 may include vertical rectangular baffles 49 that extend at a right angle from the inner surface of the main chamber 38. The baffles 49 promote turbulent mixing of the middle section of main chamber 38 in the vessel 32. The baffles 49 are attached (e.g., by nuts and bolts) to the inner surface of the portion of the housing 45 which defines the main chamber 38. In some embodiments, the length and/or position of the baffles is adjustable to achieve effective draw down of biomass from the liquid surface, turbulent mixing in the middle section of the main chamber 38 for separating contaminants and dislodging entrained air, and separation of heavy contaminants from the biomass in the tapered chamber 45. The upper ends of the baffles 49 may be maintained below the surface of the liquid.

In some embodiments, the upper end of the baffles 49 do not extend upward to the axial position of the upper impeller and do extend opposite the central impeller to maintain active surface motion and to prevent the baffles from interfering with formation of a vortex produced by the upper impeller 22 and to submergence of biomass. The baffles 49 span the axial positions of the central impeller 24, second central impeller 26 and third central impeller 28 to promote agitation of biomass and separation of contaminants. The baffles 49 may extend downward to the point at which the housing begins to taper to form the tapered chamber 44. The vessel 32 may include two or more baffles that may be equally spaced around the circumference of the vessel 32.

The height of the baffles may be adjusted by loosening the fastening devices and sliding the baffles upward or downward in the vertical direction to the desired location and refastening the baffles. Various suitable lengths of baffles may be used to achieve the desired location and length. Alternatively, each baffle includes two or more shorter sections, and the position of each section of baffle may be adjusted independently.

In some embodiments, the position and/or height of the baffles is adjusted based on the type of biomass being processed. The ratio of the width of the baffles 49 over the diameter of the main chamber 38 may be between about 1:15 to about 1:10 or between about 1:14 to about 1:12. To minimize accumulation of biomass between the wall of chamber 38 and the baffles, a gap of about 2 cm to about 5 cm between the inner wall and the inner edge of the baffles may be maintained.

While impregnation of biomass with liquid has been described herein with reference to a single soak vessel 32, it should be noted that a number of soak vessels, tanks, zones or units, connected in series or in parallel, may also be used without limitation.

In some embodiments, the liquid 8 used to impregnate the biomass is an aqueous acid. The aqueous acid may include recycle streams from upstream dewatering operations. The acid that is used for acid impregnation may be sulfuric acid, hydrochloric acid or nitric acid. Regardless of the acid that is used, the concentration of the fresh acid added to the system may be at least about 0.1 wt %, at least about 0.4 wt %, at least about 1 wt %, at least about 2 wt %, at least about 3 wt %, less than about 5 wt %, less than about 4 wt %, less than about 3 wt %, less than about 1 wt % or less than about 0.5 wt % (e.g., from about 0.1 wt % to about 5 wt % or from about 0.4 wt % to about 2 wt %). The temperature of the fluid 8 introduced in the vessel 32 may vary depending on whether the fluid-impregnation vessel includes heating elements (resistance heaters, combusted gases, steam or the like) in thermal communication with the vessel or includes direct steam injection for heating the acid and/or milled biomass material 6 during impregnation.

In some embodiments, the fluid 8 is heated and/or extraneous heat is applied to the soak vessel 32 (or a surge vessel which feeds the soak vessel) such that the fluid-impregnated biomass 10 discharged from the vessel is at a temperature of at least about 20° C., at least about 50° C. or at least about 75° C. (e.g., from about 20° C. to about 80° C. or from about 50° C. to about 60° C.). The amount of time between initial contact of the biomass 6 with fluid 8 and before downstream dewatering may be at least about 30 seconds, at least about 1 minute or at least about 5 minutes or more (e.g., from about 30 seconds to about 20 minutes, from about 1 minute to about 10 minutes or from about 2 minutes to about 8 minutes). The pH of the fluid-impregnated biomass 10 may be less than about 5, less than about 3 or less than about 1.5.

When dilute acid is used as the impregnating fluid 8, the acid may be supplied to the soak vessel 32 (or to a surge vessel) from a static in-line mixer in which concentrated acid and process water are mixed. In some embodiments, the dilute acid is supplied from a surge vessel (not shown) in which acid from various downstream dewatering operations is recycled and to which fresh acid may be added for control of pH in the surge tank. In some embodiments, the acid is supplied by introducing the acid to upstream dewatering processes and recycling acid from the dewatering process to the soak vessel 32 or surge vessel (not shown).

The fluid-impregnated biomass 10 (e.g., acid-impregnated biomass) discharged from the soak vessel 32 may have a total solids content of less than about 12 wt %, less than about 10 wt %, less than about 7 wt % or less than about 5 wt % (e.g., from about 1 wt % to about 12 wt % or from about 3 wt % to about 7 wt %). After impregnation, the fluid-impregnated biomass 10 may undergo a dewatering operation (FIG. 1) to reduce the moisture content of the biomass to an amount suitable for steam explosion. Suitable equipment for dewatering includes, for example centrifuges and filters which may be used for slurries having a total solids content of about 4 wt % of less; screens and drain-screws which may be used for inlet slurries having a total solids content less than about 18 wt %; and screw presses and plug feeders which may be used for inlet slurries having a total solids content of about 15 wt % to about 40 wt %. Depending on the equipment and the total solids content of input slurry, dewatering operations may increase the total solids content of the biomass to about 15 wt % or more, to about 20 wt % or more, to about 30 wt % or more, to about 40 wt % or more (e.g., from about 20 wt % to about 50 wt % or from about 30 wt % to about 40 wt % total solids). Dewatering produces a liquid effluent 3 (FIG. 1). The liquid effluent 3 may also include an amount of flushing liquid used in the dewatering operations.

Figure 3:
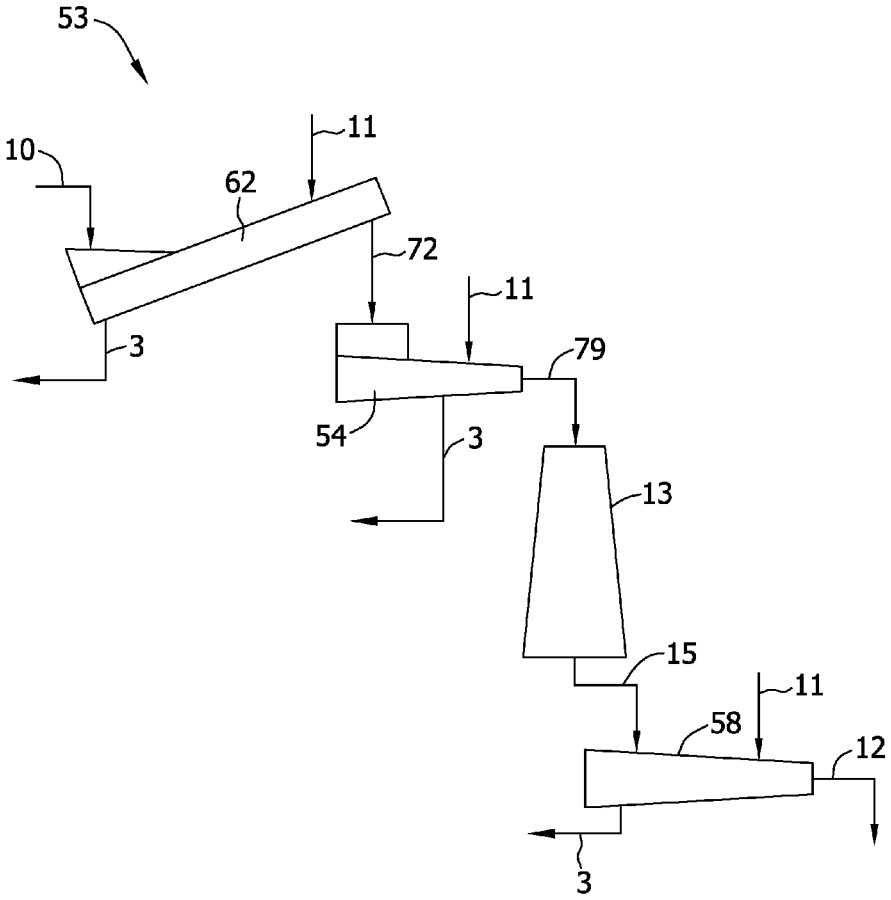
FIG. 3 is a schematic of a dewatering system for dewatering biomass.

Referring now to FIG. 3, a dewatering system 53 suitable for use in embodiments of the present disclosure includes a dewatering screw conveyor 62. The dewatering screw conveyor 62 may include a screened bottom (e.g., a u-shaped bottom in which the conveyor screw rotates) and a solid shroud beneath the bottom which allows the effluent 3 to gravity drain in the conveyor 62. Alternatively, the dewatering screw 62 may have a solid bottom, and in such case the fluid is drained back to the conveyor inlet hopper where the liquid is withdrawn by gravity via a screen fitted to the hopper walls. Fluid-impregnated biomass 10 may be pumped from the soak vessel 32 to the dewatering screw conveyor 62 or the outlet 14 of the soak vessel 32 may discharge directly into the dewatering screw conveyor 62. The dewatering screw conveyor 62 may be inclined from about 25° to about 45° relative to the horizontal plane to promote drainage of fluid from the dewatering screw conveyor 62.

The screen in the dewatering screw conveyor 62 may be wedge wire screen or perforated screen having gaps or openings from about 1 mm to about 5 mm or from about 1.5 mm to about 2.5 mm. The screen in the dewatering screw conveyor 62 may be intermittently or continually sprayed with liquid 11 (e.g., make-up acid solution or liquid effluent 3 from dewatering operations or process water) to prevent pluggage. The dewatering screw conveyor 62 may include a hopper at the inlet to provide surge capacity (e.g., up to 30 seconds residence time) for variance in feed rates. In some embodiments, the dewatering screw conveyor 62 increases the total solids content of the fluid-impregnated biomass to at least about 12 wt %, at least about 15 wt %, at least about 18 wt % or at least about 21 wt % total solids (e.g., from about 12 wt % to about 24 wt %, from about 15 wt % to about 20 wt % total solids). Alternatively, the fluid-impregnated biomass 10 may be contacted with a dewatering screen (i.e., a dewatering screen not incorporated into a screw conveyor) such as conveyor belt screens which may optionally be vibrated, sieve bend screens, rotary dewatering screens and the like.

After the initial stage of dewatering (which is typically a gravity dewatering operation), the partially dewatered biomass 72 is introduced into a screw press 54 that is in fluid communication with the dewatering screw 62. Any suitable screw press 54 may be used such as screw presses in which the inner diameter of the screw increases laterally to compress the biomass or screw presses in which the flight pitch is gradually reduced to create a compression zone. Shaftless screw presses may also be used without limitation. While not being limited to any particular orientation, shaftless screw presses may be positioned at an inclined angle and screw presses having a shaft may have a horizontal orientation. In some embodiments, a screw press having twin screws may be used.

Inside the screw press, the biomass material is increasingly compacted as it is conveyed along the housing of the screw. As the biomass is compressed, liquid is forced out of the biomass porous space and out of the screw housing through the drain openings. A small fraction of the fine biomass particles pass through the drain openings along with the expelled liquid while most of the biomass material is conveyed through the housing. The volume compression ratio inside the screw press may be from about 2:1 to about 8:1 or from about 3:1 to about 7:1 or from about 4:1 to about 6:1. The rotational speed of the screw is less than about 50 rpm or less than about 30 rpm or less than about 20 rpm. The dewatered biomass 79 discharged from the screw press 54 may have a total solids content of at least about 25 wt %, at least about 35 wt %, at least about 40 wt % or at least about 50 wt % (e.g., from about 25 wt % to about 55 wt %, from about 25 wt % to about 45 wt % or from about 35 wt % to about 45 wt %).

Flushing fluid 11 may be sprayed on the throat section (not shown) of the screw press to prevent buildup of fines expelled through the drain openings. The flushing fluid may be process water or acid (e.g., hot dilute acid). At least one spray nozzle (not shown) may be positioned above and/or to the side of each side of the throat section. For large feeders, two or more spray nozzles may be positioned on each side directing a spray pattern of liquid at the drain openings to prevent buildup of fines and to flush fines down to a collection trough (not shown) positioned below the throat section. The spray pattern may be directed at the drain openings in a manner such that the liquid exiting the drain openings is not impeded, i.e., not directly inside the opening but at an angle from above. The rate and pressure of the liquid spray can be adjusted manually or remotely using a flow control valve (not shown) in the flushing fluid supply lines. In some embodiments, the liquid flow rate to each (or selected groups) of spray nozzles may also be adjusted by use of individual flow control valves (not shown). The liquid drainage rates through the openings closer to the entrance of the throat are generally higher than the rates that are nearer to the exit zone; therefore, higher liquid spray rates may be used upstream of the throat to flush away higher amount of fines. The flushing liquid may provide sufficient flow and velocity to carry away fines that may otherwise settle out at the bottom of the trough beneath the throat of the screw press. The flushing liquid may have the same acid concentration and temperature as the dilute acid used for impregnating biomass. The effluent slurry 3 may be recycled back to the soak vessel or a surge vessel.

Dewatered biomass 79 may be introduced into a chip silo 13 which provides surge capacity for one or more downstream pretreatment digesters (not shown). The silo 13 is suitably sized to provide sufficient storage capacity to allow fluid-impregnated and dewatered biomass 12 to be introduced at a relatively constant rate to the pretreatment digester. The silo 13 may have a cylindrical shape with a diverging wall (i.e., the diameter of the bottom is larger than the diameter of the top), but may alternatively have another suitable shape. A metering device (not shown) may be used to meter biomass 15 from the silo 54 to the plug screw feeder 58. The plug screw feeder 58 may include a screw that extends through a throat section that narrows in diameter toward the discharge end of the feeder 58 to compact the biomass as it travels toward the discharge end. The throat section includes a number of openings through which liquid effluent 3 passes as the biomass is compressed. As material falls into the plug screw feeder 58, the material compresses and air and liquid effluent 3 are forced out of the biomass. The biomass forms a "plug" which isolates the high pressure digester from the lower pressure (e.g., atmospheric pressure) environment in the inlet of the feeder 58. The total solids content of the dewatered biomass 12 discharged from the plug screw feeder may be at least about 35 wt %, at least about 40 wt % or at least about 45 wt % (e.g., from about 40 wt % to about 60 wt % or from about 45 wt % to about 50 wt % total solids). Flushing fluid 11 may also be sprayed on the outside of the throat section of the screw feeder 58 to prevent buildup of fines which may occlude the drain openings.

The liquid effluent 3 discharged from the dewatering screw conveyor 62, the screw press 54 of the plug screw feeder 58 may be recycled to the soak tank 32 (FIG. 2) or to an acid surge tank (not shown).

After dewatering, the dewatered biomass 12 and steam 11 (FIG. 1) are introduced into a vessel (not shown) to cause steam explosion of the biomass material 12. Vessels for causing steam explosion of biomass may be referred to as a "pretreatment digester" or simply "digester" or "pretreatment reactor" or simply "reactor" by those of skill in the art and these terms may be used interchangeably herein. The vessel may have any suitable shape (e.g., cylindrical) and may have a vertical or horizontal orientation. Steam 11 is introduced into the vessel at an elevated pressure. Upon discharge from the vessel, the pressure is reduced rapidly which causes sudden and vigorous flash of liquid into vapor (often referred to as steam explosion). The steam explosion causes a change in the structure of the biomass (e.g., a rupture of the biomass cells) and an increase in the specific surface area of the biomass which allows the cellulose to be more accessible for downstream enzyme hydrolysis and allows the hemicellulose to be more readily solubilized. The rapid drop in pressure allows a significant portion of the hot condensate to flash off and results in lower temperature and higher solid content of pretreated material. The digester may be oriented generally vertically or horizontally or in other orientations.

In some embodiments, the mass ratio of steam 11 to dewatered biomass 12 (based on dry biomass) added to the vessel is at least about 1:6 or, as in other embodiments, at least about 1:4 or at least about 1:1.5. The pressure of steam 11 added to the vessel may be at least about 5 bar, at least about 10 bar or at least about 15 bar. The temperature of steam introduced into the vessel may be from about 150° C. to about 230° C. (e.g., from about 170° C. to about 210° C.). The temperature within the vessel (and of the biomass after sufficient residence time) may be controlled to be from about 160° C. to about 195° C. In some embodiments and regardless of whether a vertical or horizontal digester is used, the average residence time may be controlled to be between about 1 and about 10 minutes.

Upon exiting the vessel, the pressure of the biomass is quickly reduced, which causes the desired structure change in the biomass. This structure change increases the availability of cellulose to undergo downstream hydrolysis. The biomass may be discharged into a flash vessel (not shown) that is at a low pressure (e.g., about 5 bar to about 3 bar gauge) relative to the digester. The pressure difference between the steam vessel and flash vessel may be at least about 5 bar, at least about 9 bar or at least about 12 bar.

After steam explosion of biomass in the flash vessel, the pretreated biomass 20 is subjected to one or more conditioning operations (FIG. 1) which prepare the pretreated biomass for hydrolysis. Conditioning may involve various mixing operations and adjustment of biomass pH (e.g., addition of hydroxide 25 which may complex with hydrolysis inhibitors or neutralize such inhibitors).

After conditioning, the conditioned feedstock 30 is subjected to one or more hydrolysis operations. In some embodiments of the present disclosure, enzyme 27 (e.g., enzyme dispersed through a liquid medium such as water) is added to the conditioned feedstock to conduct enzymatic hydrolysis of the conditioned feedstock. Suitable enzymes include for example, cellulase, xylanase, β-xylosidase, acetyl esterase, and α-glucuronidase, endo- and exo-glucannase, cellobiase, lignin degrading enzymes, and combinations of these enzymes. Enzymatic hydrolysis may be performed in a series of steps and may include a liquefaction step in which the conditioned biomass transitions from a very high viscosity slurry to a pumpable low viscosity slurry and a saccharification step in which simple sugars are produced from cellulose and hemicellulose. Enzymatic hydrolysis may involve separation steps in which C5 sugars are separated from cellulose containing streams and/or in which lignin is separated from the biomass. Any suitable method for hydrolysis of hemicellulose and cellulose which results in fermentable (C5 and/or C6 sugars) may be used in accordance with the present disclosure without limitation.

After production of simple sugars, the sugars 40 (C5 and/or C6 sugars) may be fermented to produce ethanol. In this regard, fermentation of C5 and C6 sugars may be conducted together or separately (e.g., sequentially or in parallel in embodiments in which the C5 and C6 sugars are separated). Any suitable yeast 36 may be used depending on the sugar content and type of sugar of the fermentable stream. Saccharification and fermentation may, at least partially, be achieved in the same vessel or these operations may be performed separately.

Fermentation product stream 42 is subjected to various ethanol recovery steps (e.g., distillation and molecular sieving) to recover ethanol 50. A stillage stream 52 may be removed from the distillation bottoms which may be processed to produce various co-products such as dried distillers biomass or dried distillers biomass with solubles.

It should be noted that the process for producing ethanol from biomass feedstock shown in FIG. 1 and as described herein is simplified for clarity and commercial processes may include additional processing steps, equipment, process recycles and the like. Exemplary ethanol production based on biomass feedstock is also described in U.S. Pat. Pub. No. 2012/0006320, which is incorporated herein by reference for all relevant and consistent purposes.

Compared to traditional methods, the methods described above have several advantages. The arrangement of impellers in the impeller assembly of the soak tank allows biomass to be relatively quickly submerged after addition of biomass to the soak tank. Further, the arrangement allows biomass to be vigorously agitated which results in improved impregnation of fluid into the biomass. The impeller assembly arrangement and the tapered chamber of the soak tank and the various positions of the biomass and contaminant outlets allows the heavy contaminants to settle in the tank and be separated from biomass prior to discharge of biomass from the vessel. Further, the excess volume of acid in the soak tank allows the acid concentration in the impregnated biomass to be relatively uniform and improves pretreatment.

When introducing elements of the present disclosure or the embodiment(s) thereof, the articles "a", "an", "the" and "said" are intended to mean that there are one or more of the elements. The terms "comprising," "including," "containing" and "having" are intended to be inclusive and mean that there may be additional elements other than the listed elements. The use of terms indicating a particular orientation (e.g., "top", "bottom", "side", etc.) is for convenience of description and does not require any particular orientation of the item described.

As various changes could be made in the above constructions and methods without departing from the scope of the disclosure, it is intended that all matter contained in the above description and shown in the accompanying drawing[s] shall be interpreted as illustrative and not in a limiting sense.

What is claimed is:

1. A soak vessel for impregnating biomass with liquid and removing contaminants, the soak vessel having a vertical axis and comprising:

a housing defining a main chamber and a tapered chamber;

a biomass outlet formed in the housing in the tapered chamber, the biomass outlet having an axial position along the vertical axis;

a contaminant outlet formed in a lower end of the soak vessel in the tapered chamber, the contaminant outlet being below the biomass outlet relative to the vertical axis; and an impeller assembly comprising:

a first impeller within the main chamber configured to create a vortex to submerge the biomass;

a second impeller within the main chamber configured to agitate the biomass and separate contaminants from the biomass; and a third impeller within the tapered chamber, the third impeller being at the axial position of the biomass outlet and being configured for sweeping biomass through the biomass outlet and forcing contaminants downward toward the contaminant outlet, the contaminant outlet being below the third impeller relative to the vertical axis.

2. The soak vessel of claim 1 wherein the impeller assembly further comprises:

fourth and fifth impellers within the main chamber configured to agitate the biomass and separate contaminants from the biomass.

3. The soak vessel of claim 1 wherein the first impeller comprises at least two blades, each blade having a pitch of from about 30° to about 60°.

4. The soak vessel of claim 1 wherein the first impeller comprises at least two blades, each blade having a pitch of from about 40° to about 50°.

5. The soak vessel of claim 1 wherein the second impeller comprises at least two blades, each blade having a pitch of from about 5° to about 45°.

6. The soak vessel of claim 1 wherein the second impeller comprises at least two blades, each blade having a pitch of from about 15° to about 45°.

7. The soak vessel of claim 1 wherein the second impeller comprises at least two blades, each blade having a pitch of from about 25° to about 35°.

8. The soak vessel of claim 1 wherein the third impeller comprises at least two blades, each blade having a pitch of at least about 75°.

9. The soak vessel of claim 1 wherein the third impeller comprises at least two blades, each blade having a pitch of at least about 85°.

10. The soak vessel of claim 1 wherein the third impeller comprises at least two blades, each blade having a pitch of about 90°.

11. The soak vessel as set forth in claim 2 wherein the fourth and fifth impellers each comprise at least two blades, each blade having a pitch of from about 30° to about 60°.

12. The soak vessel as set forth in claim 2 wherein the fourth and fifth impellers each comprise at least two blades, each blade having a pitch of from about 40° to about 50°.

13. The soak vessel as set forth in claim 1 further comprising a vertical baffle attached to an inner surface of the housing.

14. The soak vessel as set forth in claim 13 wherein the vertical baffle extends opposite the second impeller and does not extend opposite the first impeller.

15. A system for soaking and dewatering biomass material, the system comprising:

the soak vessel as set forth in claim 1;

a dewatering screw having an inlet in fluid communication with the biomass outlet of the soak vessel;

a screw press in fluid communication with the dewatering screw; and a plug screw feeder in fluid communication with screw press and a pretreatment digester.

16. A method for impregnating biomass with liquid and removing contaminants, the method comprising:

introducing a biomass feedstock into a soak vessel for impregnating biomass with liquid and removing contaminants, the soak vessel having a vertical axis and a housing defining a main chamber and a tapered chamber;

rotating a first impeller within the main chamber to create a vortex to submerge the biomass;

rotating a second impeller within the main chamber to agitate the biomass and separate contaminants from the biomass; and rotating a third impeller within the tapered chamber to sweep biomass through a biomass outlet and force contaminants toward a contaminant outlet, the third impeller being at an axial position of the biomass outlet and the contaminant outlet being below the third impeller relative to the vertical axis.

17. The method as set forth in claim 16 wherein a vertical baffle is attached to an inner surface of the housing, the method further comprising controlling the level of biomass such that the biomass extends above the baffle.

18. The method as set forth in claim 17 wherein the vertical baffle extends across from the second impeller and does not extend across from the first impeller.

19. The method as set forth in claim 16 further comprising:

rotating a fourth and fifth impeller within the main chamber to agitate the biomass and separate contaminants from the biomass.

20. The method as set forth in claim 16 wherein the first impeller comprises at least two blades, each blade having a pitch of from about 30° to about 60°.

21. The method as set forth in claim 16 wherein the first impeller comprises at least two blades, each blade having a pitch of from about 40° to about 50°.

22. The method as set forth in claim 16 wherein the second impeller comprises at least two blades, each blade having a pitch of from about 5° to about 45°.

23. The method as set forth in claim 16 wherein the second impeller comprises at least two blades, each blade having a pitch of from about 15° to about 45°.

24. The method as set forth in claim 16 wherein the second impeller comprises at least two blades, each blade having a pitch of from about 25° to about 35°.

25. The method as set forth in claim 16 wherein the third impeller comprises at least two blades, each blade having a pitch of at least about 75°.

26. The method as set forth in claim 16 wherein the third impeller comprises at least two blades, each blade having a pitch of at least about 85°.

27. The method as set forth in claim 16 wherein the third impeller comprises at least two blades, each blade having a pitch of about 90°.

28. The method as set forth in claim 19 wherein the fourth and fifth impellers each comprise at least two blades, each blade having a pitch of from about 30° to about 60°.

29. The method as set forth in claim 19 wherein the fourth and fifth impellers each comprise at least two blades, each blade having a pitch of from about 40° to about 50°.

30. The method as set forth in claim 16 wherein the liquid is an aqueous acid, the aqueous acid having an acid concentration of less than about 5 wt %.

31. The method as set forth in claim 16 wherein the temperature of biomass discharged through the outlet is at least about 50° C.

32. The method as set forth in claim 16 wherein the residence time of biomass in the soak vessel is at least about 1 minute.

* * * * *